US006769825B2

(12) United States Patent
Strohdiek et al.

(10) Patent No.: US 6,769,825 B2
(45) Date of Patent: Aug. 3, 2004

(54) THERMAL PRINTER WITH LIFTABLE PRINTING HEAD

(75) Inventors: Heinz Strohdiek, Paderborn (DE); Hermann Klein, Trossingen (DE)

(73) Assignee: Hengstler GmbH, Aldingen (DE)

( * ) Notice: Subject to any disclaimer, the term of this patent is extended or adjusted under 35 U.S.C. 154(b) by 0 days.

(21) Appl. No.: 09/832,283

(22) Filed: Apr. 10, 2001

(65) Prior Publication Data

US 2002/0176727 A1 Nov. 28, 2002

(30) Foreign Application Priority Data

Mar. 22, 2001 (DE) ..... 101 14 242
Apr. 3, 2001 (DE) ..... 101 16 584

(51) Int. Cl.[7] ..... B41J 25/308
(52) U.S. Cl. ..... 400/55; 400/120.16; 400/120.17
(58) Field of Search ..... 400/56, 120.16, 400/120.17, 55; 347/197, 198

(56) References Cited

U.S. PATENT DOCUMENTS 4,750,880 A * 6/1988 Stephenson et al. ..... 347/197
4,775,869 A 10/1988 Minowa ..... 347/197
5,036,338 A 7/1991 Imai ..... 347/172
5,366,302 A * 11/1994 Masumura et al. ..... 347/197
6,097,414 A * 8/2000 Menzenski ..... 235/3

FOREIGN PATENT DOCUMENTS

| | | | | |
|---|---|---|---|---|
| DE | 3733785 | | 4/1994 | |
| DE | 4323885 | | 1/1995 | |
| JP | 01031669 A | * | 2/1989 | ..... B41J/25/30 |
| JP | 04142965 | | 5/1992 | |
| JP | 04146175 A | * | 5/1992 | ..... B41J/25/308 |
| JP | 07195795 A | * | 8/1995 | ..... B41J/25/304 |
| JP | 08058159 | | 3/1996 | |
| JP | 08224933 | | 9/1996 | |

OTHER PUBLICATIONS

Machine translation of JP 07–195795 from Japanese Patent Office website.*

* cited by examiner

*Primary Examiner*—Daniel J. Colilla
(74) *Attorney, Agent, or Firm*—Baker & Daniels

(57) ABSTRACT

A thermal printer with a printing head is described for the printing of differently thick print media, especially label course or the like, in which opposite the printing head constructed as a pressure beam there lies at least one transport roller, and the medium to be printed is led through the input gap between printing head and transport roller. So that differently thick print media, especially label courses, can be printed with little wear on the printing head, the invention provides that the pressure beam is made liftable and lowerable.

8 Claims, 6 Drawing Sheets

THERMAL PRINTER WITH LIFTABLE PRINTING HEAD

Figure 2:
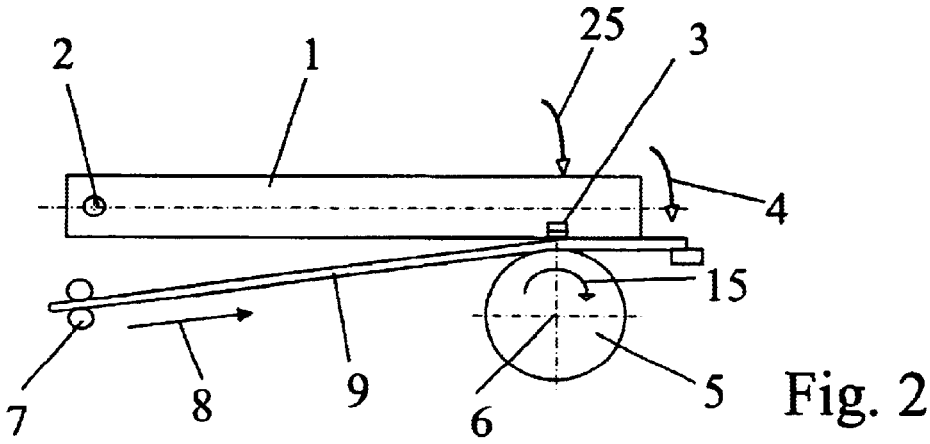

The invention relates to a thermal printer with liftable printing head.

Hitherto thermal printers have been known, especially for use in fax apparatuses, with which a one-line constructed printing mechanism imprints a thermosensitive paper.

Differently thick printing media, however, cannot be imprinted with such a printing mechanism. There are known, further, printing mechanisms for label printing, with which a label course is printed in the continuous process. Here, too, it is known to use a one-line printing head which lies opposite a corresponding counter-pressure roller, in which the medium to be printed is led through the roller gap between the printing head and the counter-pressure roller. With such printing mechanisms for thermal printers there is present, however, the disadvantage that it is possible to imprint only a relatively constant thickness of the label courses. If thicker label courses are to be printed, this leads to high wear on the printing head, because the printing head lies on the oppositely lying counter-pressure roller.

With such printing mechanisms there is present, moreover, the disadvantage that a considerable slippage occurs in the first introduction of the label course into the printing mechanism, because the label course is brought up onto the printing head under corresponding friction manifestations from the counter-pressure roller. There arises thereby a considerable abrasion on the printing head, which leads to a premature wearing-out and to high costs associated with the replacement.

It is desired to be able to print labels of different thicknesses. Especially in the case of sales labels it is required that relatively thick labels be printed, because such sales labels can have integrated with them so-called transponder coils or other theft safeguards, which lead to a considerable build-up of the label height.

Underlying the invention is the problem of developing a printing mechanism for a thermal printer of the type mentioned at the outset, in such manner that with simple means differently thick printing media, especially label courses, can be printed, with which the wear on the printing head is to be minimized.

For the solution of the problem posed the invention is characterized in that the pressure beam of the printing head is constructed liftable (i.e., moved in a direction away from) and lowerable (i.e., moved in a direction toward) with the oppositely lying transport roller.

With the given technical teaching there is yielded the essential advantage that now a variable feed gap is provided between the printing head constructed as a pressure beam and the counter-pressure roller.

This counter-pressure roller is referred to in the following also as a transport roller, for it carries out the transport movement proper. Here the transport roller presses the medium to be printed, in particular the label courses, onto the underside of the pressure beam, which according to the invention is constructed liftable and lowerable.

In a preferred form of execution of the invention, the pressure beam is constructed as a lever swingable on one side.

Here it is preferred if the lifting occurs by a mechanical lifting element and the lowering occurs automatically, namely under weight load or by a spring or another contact-pressure element.

With the given technical teaching there is yielded, therefore, the substantial advantage that now a variable feed gap is provided between the transport roller and the free swingable end of the pressure beam, because this feed gap is enlarged in part by a corresponding lifting element and—depending on the position of this element—is again reduced.

In a preferred form of execution of the invention the mentioned lifting element is constructed as a rotatably driven eccentric disk which is provided with a drive of its own allocated to this eccentric disk.

Here it is preferred if the eccentric disk is turnably borne on the same axis as the transport roller, but is driven independently from the transport roller.

Such a drive occurs, for example, over gear wheels which are suited to drive the eccentric disk separately from the transport roller.

For the infeed of a label course it is preferred, therefore, if the eccentric disk is first brought into a printing position with a cam projecting radially over the outer circumference, so that the infeed gap between the free swingable end of the pressure beam and the oppositely lying transport roller is kept as large as possible. Then a label course of arbitrary thickness is introduced into this infeed gap over a forward-thrusting drive (not further described) and, as soon as this infeed movement is ended, the rotation drive of the eccentric disk is again acted on, which is therewith turned into its minimal position, so that, conditioned by the contact-pressure element, the pressure beam now comes into opposition position to the transport roller and herewith a firmly defined infeed gap is given.

The medium to be imprinted now lies at a defined distance, between the printing head on the one hand, and the transport roller in the infeed gap on the other.

There can now take place a continuous printing operation, in which preferably the printing head always partially imprints the medium to be imprinted. After each printed line the transport roller is advanced by a further intermittent step, so that the next line of the printing format is reached and the one-line printing head now brings on the next printing line.

Instead of a thermosensitive printing head there can also be used other, one-line or optionally also multi-line printing heads, such as, for example, ink-jet printing heads, exposure printing heads that act on a corresponding exposure-capable printing medium.

With the given technical teaching, namely the use of a separately driven, turnable eccentric disk which is turnably arranged on the axis of rotation of the transport roller, there is yielded a substantial advantage over other liftable and lowerable arrangements. By reason of the design of the eccentric disk there is yielded, namely, a gentle transition between the lifting position and the lowered printing position, because, after all, the eccentric disk is constructed with a corresponding eccentric cam which brings about a corresponding sliding (and jolt-free) transition between the lifted and the lowered position of the pressure beam.

This is a substantial advantage over other lifting elements, such as, for example, an electromagnet or other abruptly acting lifting elements, because with these lifting elements there are still required additional shock absorbers and/or other measures have to be taken in order to bring about a gentle lowering of the pressure beam in the direction toward the transport roller.

Altogether, therefore, there is yielded with the proposal of a liftable printing head the substantial advantage that now arbitrarily thick media can be imprinted and that an especially gentle introducing of the print medium into the feed gap is possible, without there being present the danger that the pressure beam is damaged.

With the state of the art there is present, namely, the disadvantage that at present no defined minimal spacing is preset between pressure beam and transport roller. Therewith in every movement without printing material the roller rubs on the pressure beam. The eccentric disk offers a solution here. In the rotation of the eccentric disk the latter does not disappear behind the circumference of the transport roller, but reaches a position that brings about a minimum spacing.

The inventive object of the present invention is yielded not only from the object of the individual patent claims, but also from the combination of the individual patent claims among one another.

All the indications and features disclosed in the documents, inclusive of the abstract, especially the spatial design represented in the drawings, are claimed as essential to the invention insofar as, individually or in combination, they are novel with respect to the state of the art.

In the following the invention is explained in detail with the aid of drawings representing only one mode of execution. Here there proceed from the drawings and their description further features and advantages of the invention essential to the invention.

Figure 1:
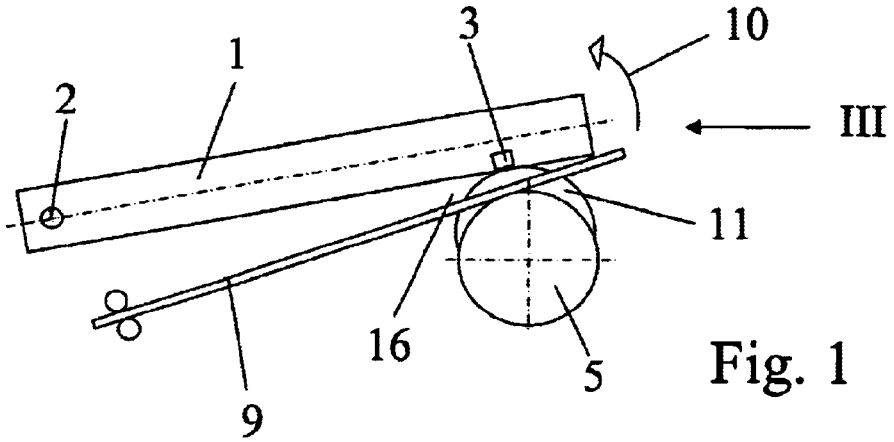
Figure 3:
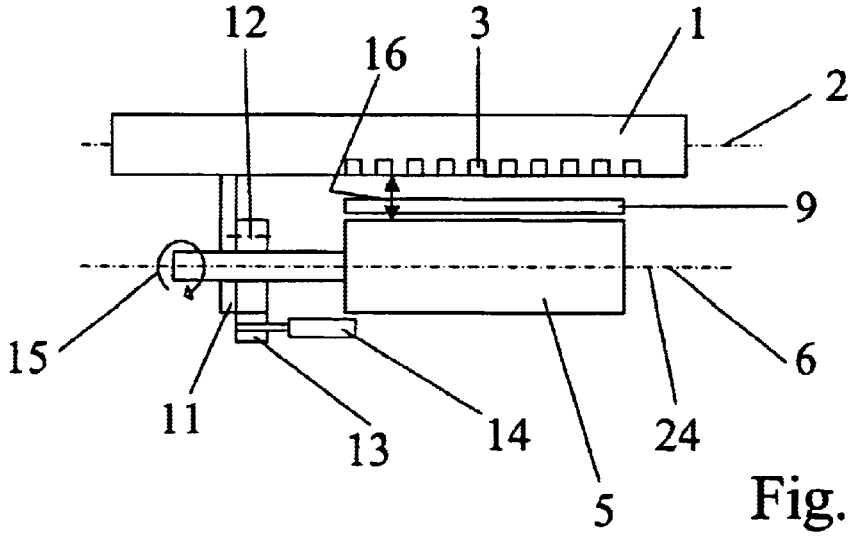
Figure 4:
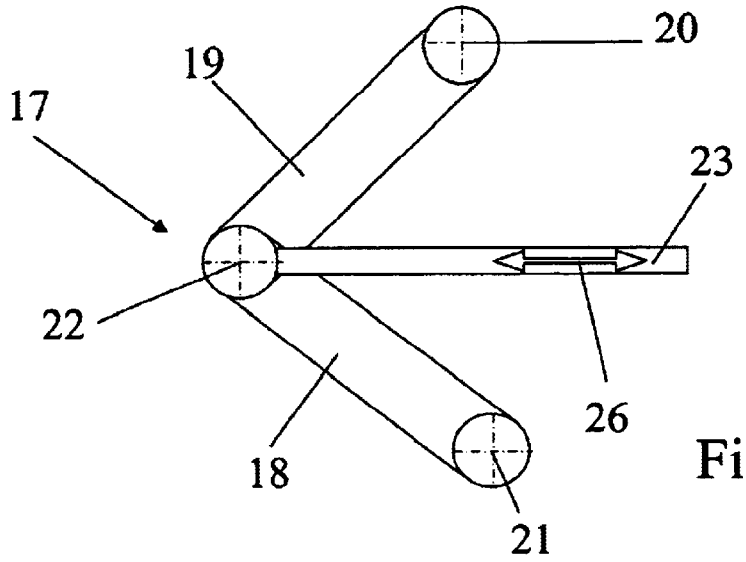
Figure 5:
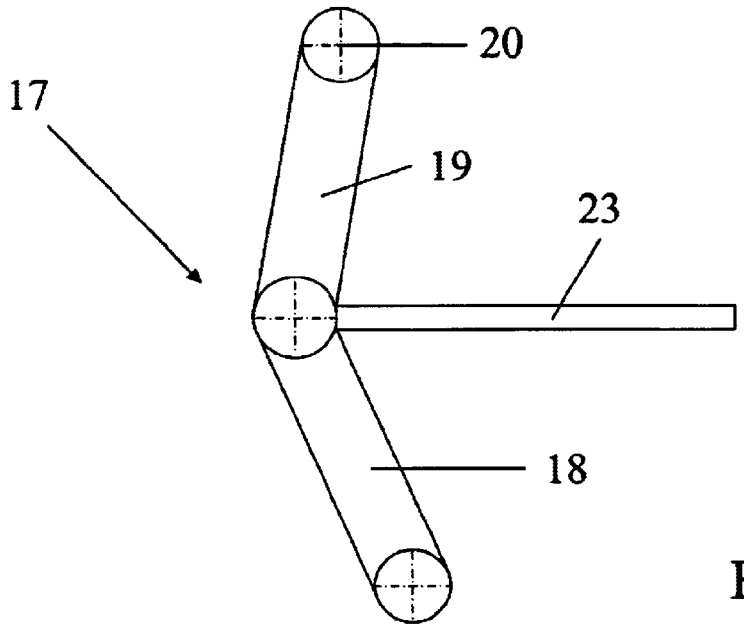

In the drawings:

FIG. 1 shows a side view of the printing mechanism according to the invention in the raised position;

FIG. 2 a side view according to FIG. 1 in the lowered position;

FIG. 3 a face view of the printing mechanism in arrow direction III in FIG. 1;

FIG. 4 an execution modified with respect to FIGS. 1–3, with a toggle lever in folded position;

FIG. 5 the same representation as FIG. 4 with extended toggle lever.

Figure 6:
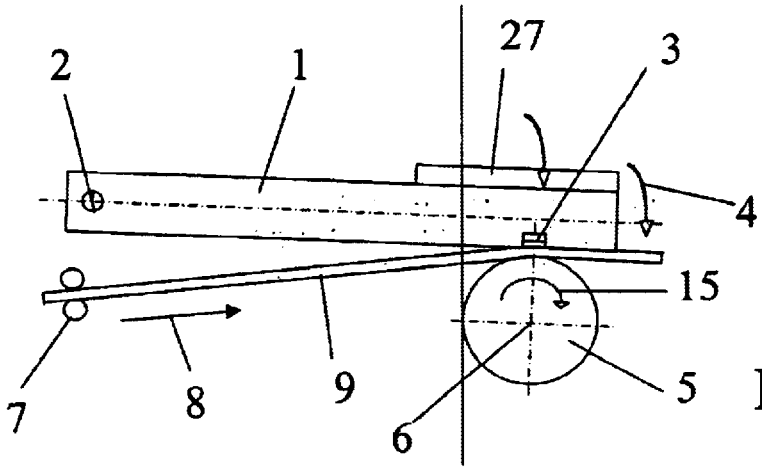
Figure 7:
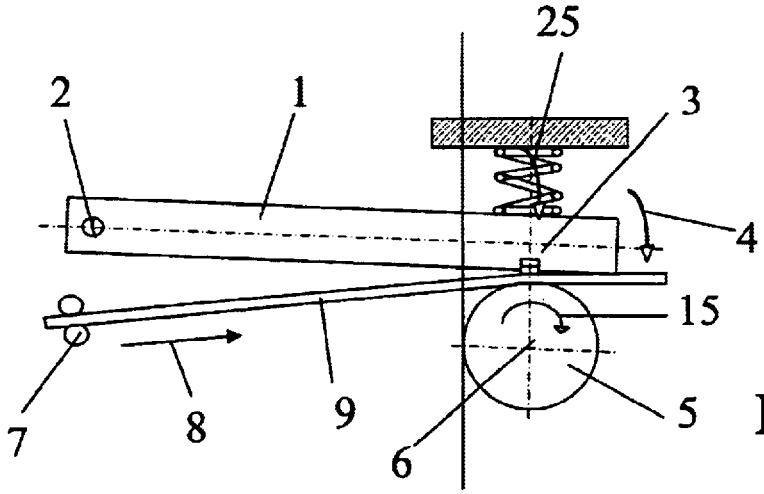
Figure 8:
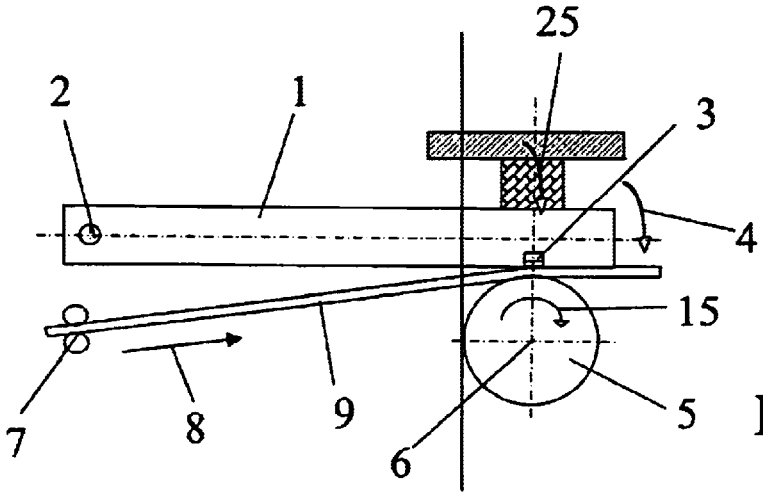
Figure 9:
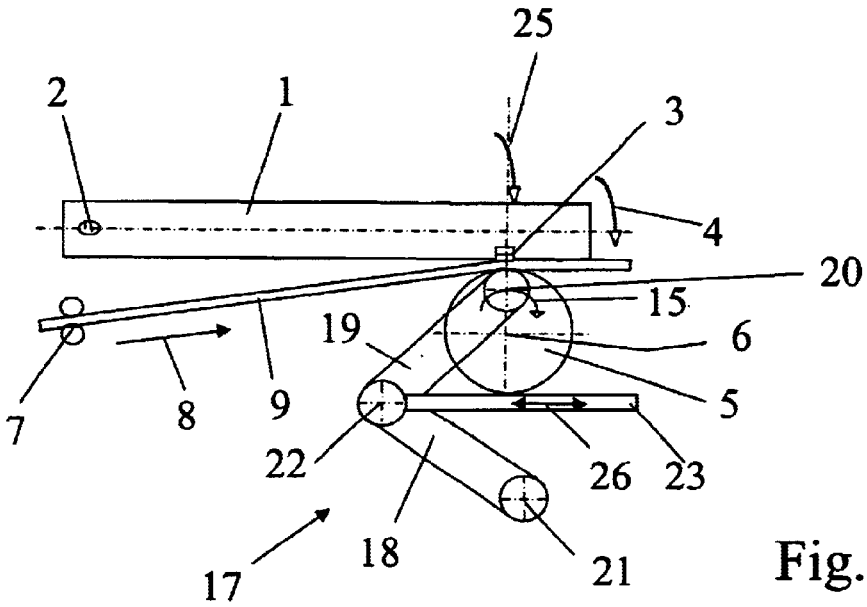
Figure 10:
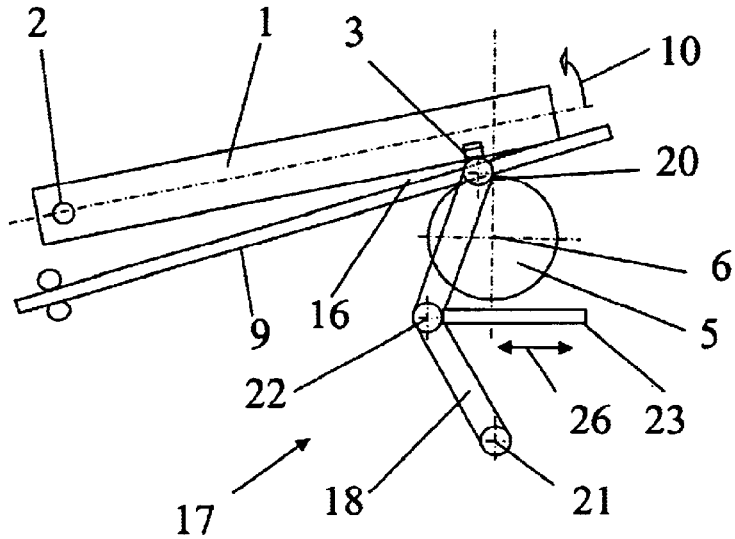
Figure 11:
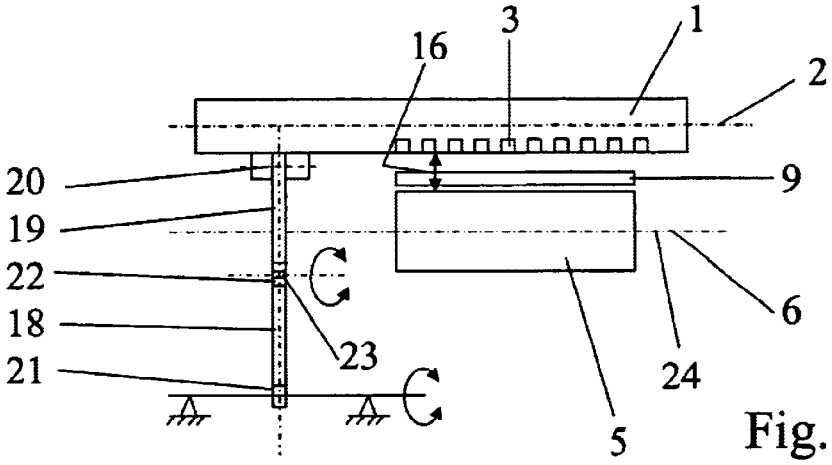
Figure 12:
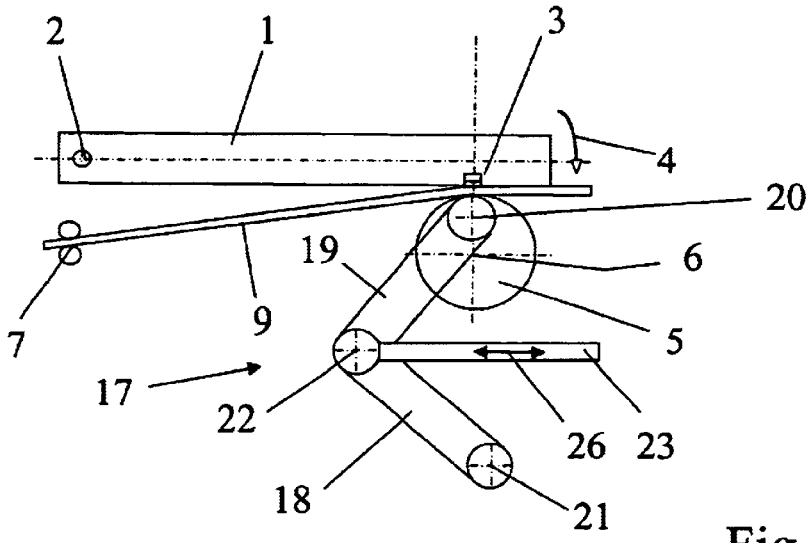
Figure 13:
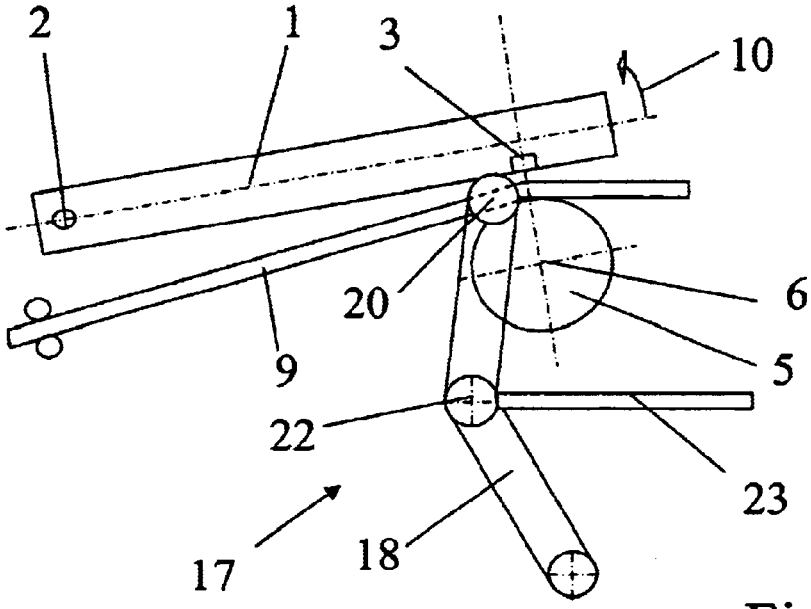

FIG. 6 a side view according to FIG. 1 in the lowered position and including a weight-type lowering element;

FIG. 7 a side view according to FIG. 1 in the lowered position and showing a spring-type lowering element;

FIG. 8 a side view according to FIG. 1 in the lowered position including a rubber-type lowering element;

FIG. 9 a side view similar to FIG. 1 but modified to substitute a toggle lever in folded position;

FIG. 10 a side view similar to FIG. 9 but wherein the toggle lever is in the extended position;

FIG. 11 a face view with the toggle lever in the extended position as in FIG. 10;

FIG. 12 an enlarged side view similar to FIG. 9;

FIG. 13 an enlarged side view similar to FIG. 10; and

Figure 14:
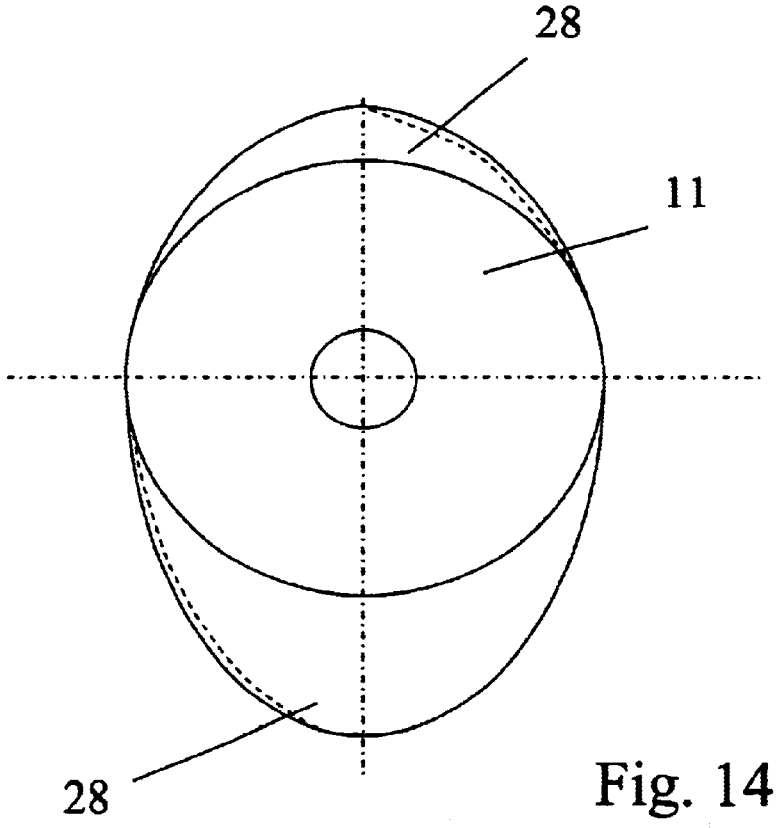

FIG. 14 an enlarged side view of an alternative eccentric disk for use in the embodiment of FIG. 1.

The printing mechanism with liftable pressure beam 1 consists essentially of a pressure beam 1 constructed about in beam form in side view, which is swingably borne in a fixed pivot bearing 2.

On the front, free end of this lever borne on one side there is arranged here the printing head 3, which is constructed preferably as a one-line printing head. To this, however, the invention is not restricted; the printing head 3 can also be in multiple-line construction.

In FIG. 1 the lifted position of the pressure beam 1 is represented, which accordingly is raised in arrow direction 10, so that an enlarged feed gap 16 is yielded.

Lying opposite the printing head 3 there is arranged a transport roller 5, which is driven in rotation, for example, in arrow direction 15. It can also be driven, for various other processes, in the opposite direction to this, or instead of the drive for the transport roller 5 there can also be provided forward-thrust rollers of their own, which transport the printing material 9 to be printed into and through the feed gap 16.

In the example of execution according to FIGS. 1 and 2 it is represented, for example, that an infeed drive 7 transports the printing material 9 in arrow direction 8 into the feed gap 16. The transport roller 5 is turnably borne in a rotary bearing 6 and driven in rotation over a drive (not further represented). What is important now is that the raised position is reached by a lifting element which, in the example of execution shown, consists of a rotationally driven eccentric disk 11. This eccentric disk has, in the example of execution according to FIG. 1., a single cam going below the circumference of the transport roller 5. To this, however, the invention is not restricted; eccentric disks can be provided which, for example, have two cams 28 lying opposite one another, which are to execute the corresponding lifting action (FIG. 14). If, namely, the eccentric disk 11, by reason of its rotary drive, is turned into the position represented in FIG. 1, then the cam of the eccentric disk 11 is pressed off on the underside of the pressure beam 1 and lifts this in arrow direction 10.

For the rotary drive it is given in FIG. 3 as an example that the eccentric disk is connected untwistably with a gear wheel 12 which meshes with a pinion 13, which in turn is acted upon by a drive 14.

Now if the eccentric disk is now driven in such manner that the eccentric disk again disappears behind the circumference of the transport roller 5, then the printing according to FIG. 2 is reached. The pressure beam 1 is swung downward in arrow direction 4, in which process the swinging can occur under weight load 27 (FIG. 6) and/or under the action of a contact pressure element 25. This contact pressure element 25 can be, for example, a contact pressure spring 25*a* (FIG. 7), a contact pressure rubber 25*b* (FIG. 8) or another elastic energy storer.

FIG. 3 shows, still schematically, that only a single print line of the printing head 3 is present. To this, however, the invention is not restricted; there can also be provided several print lines arranged-parallel to one another in FIG. 3 of a printing head 3.

FIG. 3 shows, further, that the lifting element in the form of the eccentric disk 11 is arranged only on one side of the pressure beam 1. To this, however, the invention is not restricted. On the present invention it can also be provided that on the opposite side of the transport roller 5 a similar lifting arrangement is provided with a further eccentric disk 11, which, for example, is acted upon in turning by this same drive 14.

FIGS. 4–13 show an alternative to the previously described lifting element in the form of the eccentric disk 11. Here a toggle lever 17 is represented, which can be thrust into an extended position or into a folded position. The toggle lever consists of two levers 18, 19 joined with one another by a pivot bearing 22, the lower lever 18 being held in a pivot bearing 21.

A drive rod 23 is present which is driven slidably into the arrow direction 26 and which acts directly on the pivot bearing 22.

In the folded-together position of the toggle lever 17 (FIGS. 9 and 12) therewith the lifting surface at the upper free end of the lever 19 does not come to bear on the underside of the pressure beam 1. This surface remains rather behind the circumference of the transport roller 5.

If, in contrast, the drive rod 23 is acted upon to the right in arrow direction 26, then the toggle lever extends itself and the lifting surface 20 passes into its raised position 20, whereby this surface now comes to bear on the underside of the pressure beam 1 and lifts this in arrow direction 10 (FIGS. 10, 11 and 13).

In this manner, therefore, another, translationally driven lifting surface is described, which presents an alternative to the rotationally driven lifting element in the form of the eccentric disk 11.

A further essential feature of the invention is that the lifting surface 20, 20 can also be firmly bound with the pressure beam 1, so that, therefore, there can be present a forced coupling between the rotary axis 6 of the transport roller 5 and the pressure beam 1 in its free swingable range.

| Reference numbers of the drawings | |
|---|---|
| 1 | Pressure beam |
| 1 | Pivot bearing |
| 3 | Printing head |
| 4 | Arrow direction |
| 5 | Transport roller |
| 6 | Rotary bearing |
| 7 | Infeed drive |
| 8 | Arrow direction |
| 9 | Printing material |
| 10 | Arrow direction |
| 11 | Eccentric disk |
| 12 | Gear wheel |
| 13 | Pinion |
| 14 | Drive |
| 15 | Arrow direction |
| 16 | Feed gap |
| 17 | Toggle lever 17' |
| 18 | Lever |
| 19 | Lever |
| 20 | Print-off surface 20' |
| 21 | Pivot bearing |
| 22 | Pivot bearing |
| 23 | Drive rod |
| 24 | Position |
| 25 | Contact-pressure element |
| 26 | Arrow direction |

What is claimed is:

1. A thermal printer for the printing of differently thick print media, comprising:

a pressure beam;

a printing head supported on said pressure beam;

a transport roller positioned opposite said printing head and rotatable about an axis, whereby media to be printed is led through a feed gap between said print head and said transport roller;

said pressure beam constructed as a swingable lever pivotable about a fixed axis and having a portion carrying said printing head that is liftable and lowerable relative to said transport roller;

a rotatably driven eccentric disk having a drive of its own, said disk acting on said beam to lift said beam as said disk is rotated, said disk being rotatable about an axis that coincides with the transport roller axis; and a weight loaded lowering element acting on said pressure beam to lower said pressure beam without spring pressure;

said eccentric disk driven to rotate independently of said transport roller.

2. The thermal printer of claim 1 wherein said eccentric disk includes a pair of cams disposed opposite of one another and adapted to engage said beam to lift said beam.

3. A thermal printer for the printing of differently thick print media, comprising:

a pressure beam;

a printing head supported on said pressure beam;

a transport roller positioned opposite said printing head and rotatable about an axis, whereby media to be printed is led through a feed gap between said print head and said transport roller;

said pressure beam constructed as a swingable lever having a portion carrying said printing head that is liftable and lowerable relative to said transport roller;

a rotatably driven eccentric disk having a drive of its own, said disk acting on said beam to lift said beam as said disk is rotated, said disk being rotatable about an axis that coincides with the transport roller axis;

said eccentric disk driven to rotate independently of said transport roller; and a lowering element engaging said beam to automatically lower said beam and thereby move said printing head toward said transport roller, said lowering element comprising a weight loaded lowering element acting on said pressure beam to lower said pressure beam without spring pressure.

4. The thermal printer of claim 3 wherein said eccentric disk includes a pair of cams disposed opposite of one another and adapted to engage said beam to lift said beam.

5. A thermal printer for the printing of differently thick print media, comprising:

a pressure beam;

a printing head supported on said pressure beam;

a transport roller positioned opposite said printing head and rotatable about an axis, whereby media to be printed is led through a feed gap between said print head and said transport roller;

said pressure beam constructed as a swingable lever having a portion carrying said printing head that is liftable and lowerable relative to said transport roller;

a mechanical lifting element in the form of a toggle lever mechanism comprising: a first lever and a second lever pivotably joined together at a first pivot bearing, said first lever connected to a stationary second pivot bearing at a position on said first lever spaced from said first pivot bearing; said second lever having a lifting surface that is in operative lifting engagement with said pressure beam; and a rectilinearly movable drive member acting on said first pivot bearing, whereby when said drive member is moved linearly, said levers extend relative to each other thereby causing the lifting surface of said second lever to lift said pressure beam in a direction away from said transport roller, and a weight loaded lowering element acting on said pressure beam to lower said pressure beam without spring pressure.

6. The thermal printer of claim 5 wherein said second lever lifting surface is positively connected to said pressure beam, whereby said second lever acts to both open and close the feed gap.

7. A thermal printer for the printing of differently print media, comprising:

a pressure beam;

a printing head supported on said pressure beam;

a transport roller positioned opposite said printing head and rotatable about an axis, whereby media to be printed is led through a feed gap between said print head and said transport roller;

said pressure beam constructed as a swingable lever having a portion carrying said printing head that is liftable and lowerable relative to said transport roller;

a mechanical lifting element in the form of a toggle lever mechanism comprising: a first lever and a second lever pivotably joined together at a first pivot bearing, said first lever connected to a stationary second pivot bearing at a position on said second lever spaced from said first pivot bearing; said second lever having a lifting surface that is in operative lifting engagement with said pressure beam; and a rectilinearly movable drive member acting on said first pivot bearing, whereby when said drive member is moved linearly, said levers extend relative to each other thereby causing the lifting surface of said second lever to lift said pressure beam in a direction away from said transport roller; and a lowering element engaging said pressure beam to automatically lower said beam and thereby move said printing head toward said transport roller, said lowering element comprising a weight loaded lowering element acting on said pressure beam to lower said pressure beam without spring pressure.

8. The thermal printer of claim 7 wherein said second lever lifting surface is positively connected to said pressure beam, whereby said second lever acts to both open and close, the feed gap.

* * * * *